United States Patent [19]

Gage

[11] 3,947,158

[45] Mar. 30, 1976

[54] OIL WELL PUMP WITH RESILIENT PLUNGER CUP MEANS

[76] Inventor: Lonnie L. Gage, R.R. 3 Box 69, Walters, Okla. 73572

[22] Filed: May 13, 1974

[21] Appl. No.: 469,225

[52] U.S. Cl. ..... 417/554; 92/257

[51] Int. Cl.[2] ..... F04B 21/04; F04B 39/10

[58] Field of Search ..... 417/552, 506, 554; 92/250, 92/257–258, 255, 205–206; 277/205, 206, 206.1, 116.2; 137/514

[56] References Cited

UNITED STATES PATENTS

| | | | |
|---|---|---|---|
| 262,953 | 8/1882 | Jarecki | 92/250 |
| 464,418 | 12/1891 | Bird | 92/206 |
| 1,027,665 | 5/1912 | Parker | 417/554 |
| 1,133,270 | 3/1915 | Dale | 417/506 |
| 1,503,652 | 8/1924 | Howe et al. | 92/205 |
| 2,199,950 | 5/1940 | Flinchum | 92/258 |
| 2,279,238 | 4/1942 | Larson | 92/206 |

*Primary Examiner*—Carlton R. Croyle
*Assistant Examiner*—O. T. Sessions
*Attorney, Agent, or Firm*—Head & Johnson

[57] ABSTRACT

An oil well subsurface pump comprising a plunger reciprocally disposed within a working barrel and having check valve means carried thereby, metallic ring means provided on the outer periphery of the plunger for engaging the inner periphery of the working barrel, resilient sleeve or cup means disposed around the outer periphery of the plunger and having one end in engagement with the ring means, means threadedly secured to the outer periphery of the plunger for engaging the opposite end of the resilient means for applying selected longitudinal pressure thereon for radial expansion thereof into engagement with the inner periphery of the working barrel.

1 Claim, 5 Drawing Figures

OIL WELL PUMP WITH RESILIENT PLUNGER CUP MEANS

CROSS-REFERENCE TO RELATED APPLICATIONS

This application is an improvement over the oil well pump disclosed in my copending applications Ser. No. 429,542, filed Jan. 2, 1974 and entitled "Oil Well Pump" and Ser. No. 445,285, now U.S. Pat. No. 3,910,730, filed Feb. 22, 1974 and entitled "Oil Well Pump."

BACKGROUND OF THE INVENTION

1. Field of the Invention

This invention relates to improvements in oil well pumps and more particularly, but not by way of limitation, to a reciprocal plunger type subsurface pump.

2. Description of the Prior Art

In producing oil wells it is common practice to provide a pump at the bottom of the well bore, or at least down the well bore in the proximity of the producing formation. The pump is normally secured to the lower end of the sucker rod string, which extends longitudinally through the well bore from a reciprocating device at the surface of the ground. The reciprocating device at the surface is usually a horsehead type apparatus and alternately raises and lowers the string of sucker rods in the well bore. Subsurface pumps have long presented many problems in lifting of the well fluid to the surface of the ground. For example, most pumps presently available have an inner barrel or plunger 2½ feet to 8 feet long which cause friction and drag on the pumper as the plunger reciprocates within the working barrel. As a result it is usually necessary to load the pump by the weight of the rods pushing down on the plunger. If the plunger does not move freely, the plunger may not have a full stroke, thus reducing pumping efficiency. In addition, many of the subsurface pumps have slippage in the operation of the plunger and require several strokes of the pump before a sufficient load is applied to the pump for starting the pumping action. Also, many well fluids contain sand and other foreign particles which greatly hinder the operation of the subsurface pump and frequently damage the working parts thereof. The pumping of heavy viscous fluids also presents a problem to the ususal pump available today.

SUMMARY OF THE INVENTION

The subsurface pumps disclosed in my aforementioned copending applications were developed particularly for overcoming the above disadvantages, and have been successful in producing results greatly improved over the results of prior subsurface pumps. However, there are some instances wherein it has proven advantageous to provide resilient cup means in combination with metallic seal rings on the outer periphery of the pump plunger. The present invention contemplates an improved subsurface oil well pump wherein the plunger is preferably only 9 to 12 inches long and at least one metallic ring or stop member may be provided on the outer periphery of the plunger, preferably in the proximity of the upper end thereof, with a resilient cup or sleeve means disposed on the outer periphery of the plunger having one end thereof in engagement with the metallic ring. Jamb nut means, or the like, is movably secured on the plunger for selective engagement with the opposite end of the resilient means for applying longitudinal pressure thereagainst whereby the resilient means is expanded radially outwardly into a desired engagement with the inner periphery of the working barrel. The jamb nut means may be an annular sleeve or ring member threadedly secured to the outer periphery of the plunger or may be check valve cage means threadedly secured to the plunger in a manner to provide a check valve for the pump and to provide pressure engagement means for the resilient means. The material from which the resilient cup or sleeve means is constructed is particularly selected to be resistant to the bottom hole temperatures and pressures and the corrosive characteristics of the well fluids. The novel pump is simple and efficient in operation and economical and durable in construction.

DESCRIPTION OF THE PREFERRED EMBODIMENTS

Figure 1:
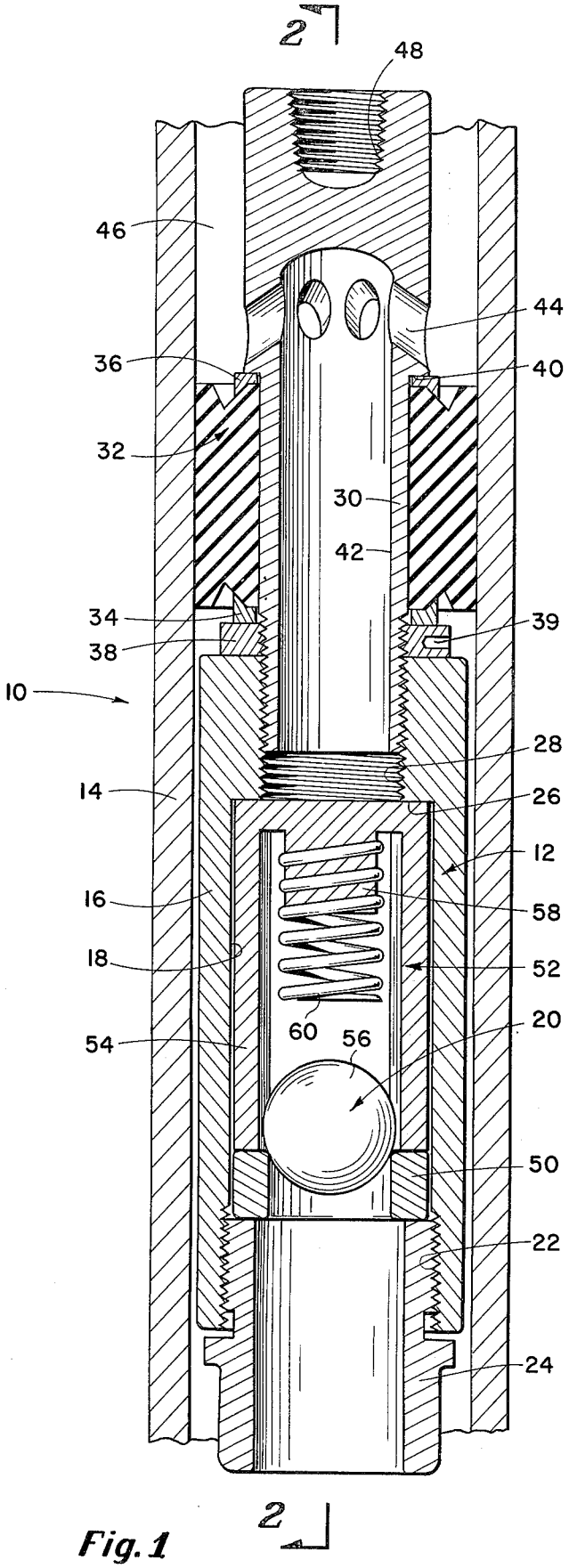
FIG. 1 is a sectional elevational view of an oil well pump embodying the invention.

Referring now to FIGS. 1, 2, 4 and 5, reference character 10 generally indicates a subsurface pump for oil well bores (not shown) and the like, and comprises a plunger assembly 12 reciprocally disposed within a working barrel 14. The working barrel 14 is preferably set within a well tubing (not shown) by a suitable packer (not shown), or the like, as is well known and in such a manner that the pump 10 is disposed in the proximity of or within the producing subsurface formation (not shown) of the well bore (not shown). However, it is to be noted that it may be desirable to retain the pump plunger assembly 12 stationary and reciprocate the working barrel 14 with respect thereto during the pumping operation.

The plunger assembly 12 comprises a main sleeve or housing 16 having a central bore 18 extending longitudinally therethrough for receiving a check valve assembly 20 therein. One end of the bore 18 is threaded as shown at 22 for receiving a sleeve 24 to removably retain the check valve assembly 20 within the sleeve 24. An inwardly directed annular shoulder 26 is provided in the bore 18 longitudinally spaced from the threaded portion 22 for receiving the upper end of the check valve assembly 20 thereagainst, as particularly shown in FIGS. 1 and 2. The bore 18 is reduced at 28 and is preferably threaded for receiving a threaded end of a stem member 30 therein.

The stem 30 extends longitudinally from the sleeve 16 and a resilient sealing sleeve 32 is disposed around the outer periphery thereof for engagement with the inner periphery of the working barrel 14 in a manner and for a purpose as will be hereinafter set forth. The sleeve 32 is preferably constructed from a suitable resilient material such as rubber or the like which is capable of withstanding the high temperature and pressure in the well bore and the corrosive characteristics of the well fluid. A pair of oppositely disposed reinforcing rings 34 and 36 are provided at the opposite ends of the sleeve 32. The ring 34 is slidably disposed around the outer periphery of the stem 30 and a suitable jamb nut 38 is interposed between the ring 34 and the upper end of the sleeve 16 and is threadedly secured to the outer periphery of the stem 30. An outwardly extending annular shoulder 40 is provided on the outer periphery of the stem 30 spaced from the threaded end thereof and provides a stop member for receiving the ring 36 thereagainst.

A central bore 42 extends longitudinally into the stem 30 and has one end thereof in open communication with the interior of the check valve assembly 20. A plurality of circumferentially spaced bores 44 are provided in the walls of the stem 30 at the opposite end of the bore 42 for providing communication between the bore 42 and the annular space 46 between the stem 30 and the inner periphery of the working barrel 14. The bores 44 are preferably disposed at a downwardly and outwardly extending angle to provide a jet-like action during operation of the pump 10 as will be hereinafter set forth.

Figure 2:
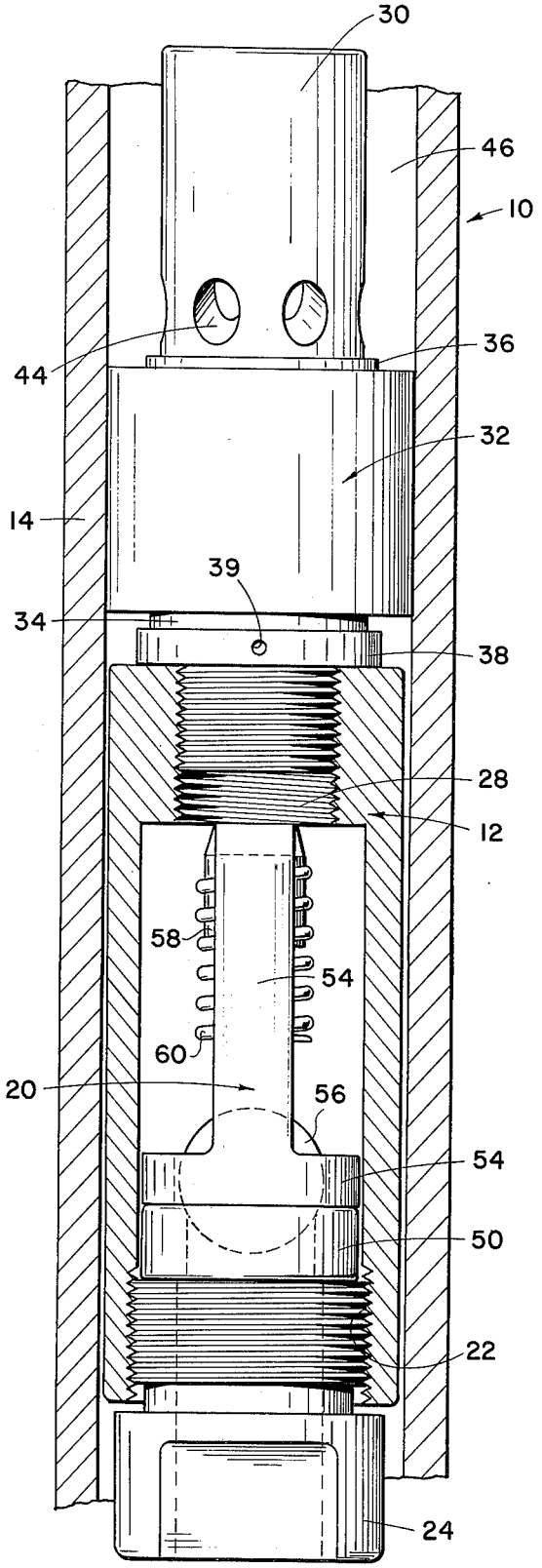
FIG. 2 is a view taken on line 2—2 of FIG. 1, with portions depicted in elevation for purposes of illustration.

The upper end of the stem 30 as shown in FIGS. 1 and 2 is closed and is provided with a central longitudinal threaded bore 48 for connection with the usual sucker rods (not shown) or the like normally utilized for reciprocating the pump plunger 12 within the working barrel 14 as is well known. It is to be noted that the particular embodiment shown herein is for use with solid sucker rods. In the event hollow sucker rods are utilized, it may be desirable to deliver the well fluid to the surface of the ground through the sucker rods, in which event the bores 44 may be eliminated, and the bore 42 may extend longitudinally completely through the stem 30.

The check valve 20 as shown in FIGS. 1 and 2 comprises an annular valve seat 50 disposed on the sleeve 24 and supporting an open-type cage member 52 thereon. The cage 52 comprises an annular base element 54 having an inverted substantially U-shaped strap member 54 integral therewith or rigidly secured thereto. The upper end of the U-strap 54 is normally held in engagement with the annular shoulder 26 and a ball member 56 is loosely disposed within the cage 52 for cooperation with the valve seat 50 to provide alternate open and closed positions for the check valve 20. A centrally disposed stop member 58 is integral with or suitably rigidly secured to the upper end of the U-strap 54 and extends longitudinally within the cage 20 for limiting the upward movement of the ball 56 during opening of the valve 20. A suitable helical spring 60 is disposed around the stop member 58 and has one end thereof suitably anchored in the proximity of the U-strap 54 and the opposite end thereof normally freely suspended below the outer extremity of the stop 58 for initial engagement with the ball 56 during opening of the valve 20 for reducing the shock on the ball 56 upon engaging the stop member 58.

Figure 4:
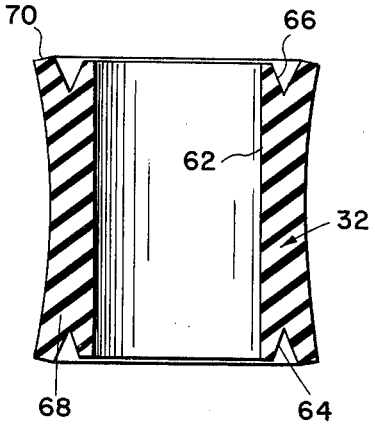
FIG. 4 is a sectional elevational view of a sealing sleeve such as may be utilized in the invention and depicts the sleeve in a relaxed position.
Figure 5:
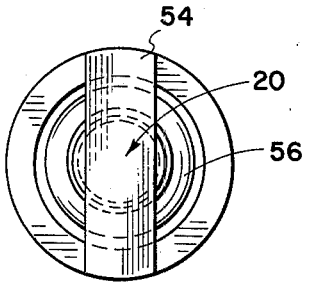
FIG. 5 is a top view of a check valve and cage member such as may be utilized in the invention.

As particularly shown in FIG. 4 the resilient sleeve 32 as shown herein is provided with a substantially straight walled inner bore 62 extending longitudinally therethrough and of a diameter for snugly fitting on the outer periphery of the stem 30. The outer periphery of the sleeve 32 is concave in the normal or relaxed position thereof and the opposite ends are provided with annular grooves 64 and 66, respectively, of a substantially V-shaped cross-sectional configuration. The grooves 64 and 66 provide outwardly extending annular lips 68 and 70, respectively, on the outer periphery of the opposite ends of the sleeve 32. Any fluid surrounding the sleeve 32 tends to enter the grooves 64 and 66 and apply radial outward pressure for forcing the lips 68 and 70 into a tight engagement with the inner periphery of the working barrel 14. In addition, the overall length of the sleeve 32 may be shortened by moving the jamb nut 38 in a direction toward the sleeve 32 to apply axial pressure thereagainst. Of course, as the length of the sleeve 32 is shortened, the sleeve is expanded radially outwardly for increasing the outer diameter thereof. The jamb nut 38 may be adjusted with respect to the sleeve 32 to provide substantially any desired pressure engagement of the sleeve 32 against the inner periphery of the working barrel 14. In the event any wear occurs on the outer periphery of the working barrel 14 during use of the pump 10, the jamb nut 38 may be further adjusted to increase the pressure of the sleeve 32 against the working barrel 14 as desired.

Whereas the sleeve 32 as shown herein is of one particular configuration it is to be understood that the sleeve 32 may be simply a "regular" resilient sleeve having concentric inner and outer peripheries even in the relaxed position thereof and there is no intention of limiting the invention to the particular sleeve shown herein.

A standing valve (not shown) is normally installed in the lower portion of the well bore or well tubing (not shown) and the working barrel 14 is set in the well tubing (not shown) in the proximity of the producing formation in any well known manner and preferably above the standing valve (not shown). In order to install the plunger assembly 12 in the working barrel 14 it is preferable to attach a seating nipple (not shown) to the upper end of the working barrel 14 in any suitable manner, such as by a threaded connection therebetween. The upper end of the seating nipple is preferably provided with a beveled edge around the inner periphery thereof and as the plunger assembly 12 is lowered in the well tubing (not shown), the lowermost end of the assembly 12 will initially engage the upper end of the seating nipple. In the event the plunger assembly 12 is not exactly in axial alignment with the seating nipple and/or working barrel 14, the plunger assembly will engage the beveled edge of the nipple and will be easily guided into a centered or aligned position with respect to the nipple and working barrel. The assembly 12 may then be readily moved by gravity into the inner bore of the working barrel 14. In this position the sleeve 24 is open to or in communication with the fluid reservoir (not shown) provided in the well tubing (not shown).

The pump plunger assembly 12 may be reciprocated within the working barrel 14 by the normal sucker rods (not shown) in the usual manner. On the upstroke of the plunger assembly 12, a suction is created in the well tubing above the standing valve for opening the standing valve and pulling a quantity of well fluid into the interior of the well tubing. It will also be apparent that the ball 56 will be urged against the valve seat 50 upon the upstroke of the plunger assembly 12 for closing of the ball check valve 20. On the downstroke of the plunger assembly 12 the pressure of the fluid in the well tubing will raise the ball 56 from the valve seat 50 for opening of the ball check valve 20 (sometimes called a travelling valve). The well fluid will move through the open valve 20 and into the interior of the cage 52. The construction of the cage 52 is of a particular design to provide a maximum internal volume for the check valve 20 in order to produce a minimum restriction of fluid flow through the valve and into the bore 42. The upward movement of the ball 56 is limited by the engagement thereof with the stop member 58. Of course, the ball 56 initially engages the free end of the spring 60 which dampens the force of the engagement of the ball 56 with the stop member 58.

As the plunger assembly 12 is continuously reciprocated within the barrel 14, the fluid moved upwardly through the passageway 42 and is discharged through the ports 44 into the annulus 46 and moves upwardly therein to the surface of the well, as is well known. The fluid is discharged from the ports 44 in a jet-like action which maintains the upper end of the sleeve 32 substantially clean and free of sand accumulations and the like.

The outer periphery of the sleeve 32 moves against the inner periphery of the working barrel 14 during reciprocation of the plunger assembly 12 for substantially precluding any leakage of well fluid between the sleeve 16 and the working barrel 14 whereby each stroke of the pump plunger assembly 12 delivers fluid into the working barrel 14 above the plunger assembly 12 with substantially no slippage between the plunger and the working barrel. In addition, the sleeve 32 will function as a wiper ring against the inner periphery of the barrel 14. As wear occurs on either the outer periphery of the sleeve 32 or the inner periphery of the barrel 14, the outer diameter of the sleeve 32 may be selectively increased by moving the jamb nut 38 in a direction toward the sleeve 32. This may be accomplished in any well known manner, such as by inserting an Allen wrench (not shown) or the like into a complementary bore 39 provided in the outer periphery of the nut 38 in order to rotate the nut 38 on the threaded end of the stem 30. In addition, any well fluid present above and below the sleeve 32 will cause a fluid accumulation in the grooves 64 and 66 for urging the lips 68 and 70 radially outwardly into a tight sealing engagement with the inner periphery of the working barrel 14.

As hereinbefore set forth, in the event hollow sucker rods are utilized in lieu of solid sucker rods, it may be desirable to eliminate the ports 44 and move the fluid upwardly from the bore 42 through the hollow sucker rods for elevating the well fluid to the surface of the ground.

Figure 3:
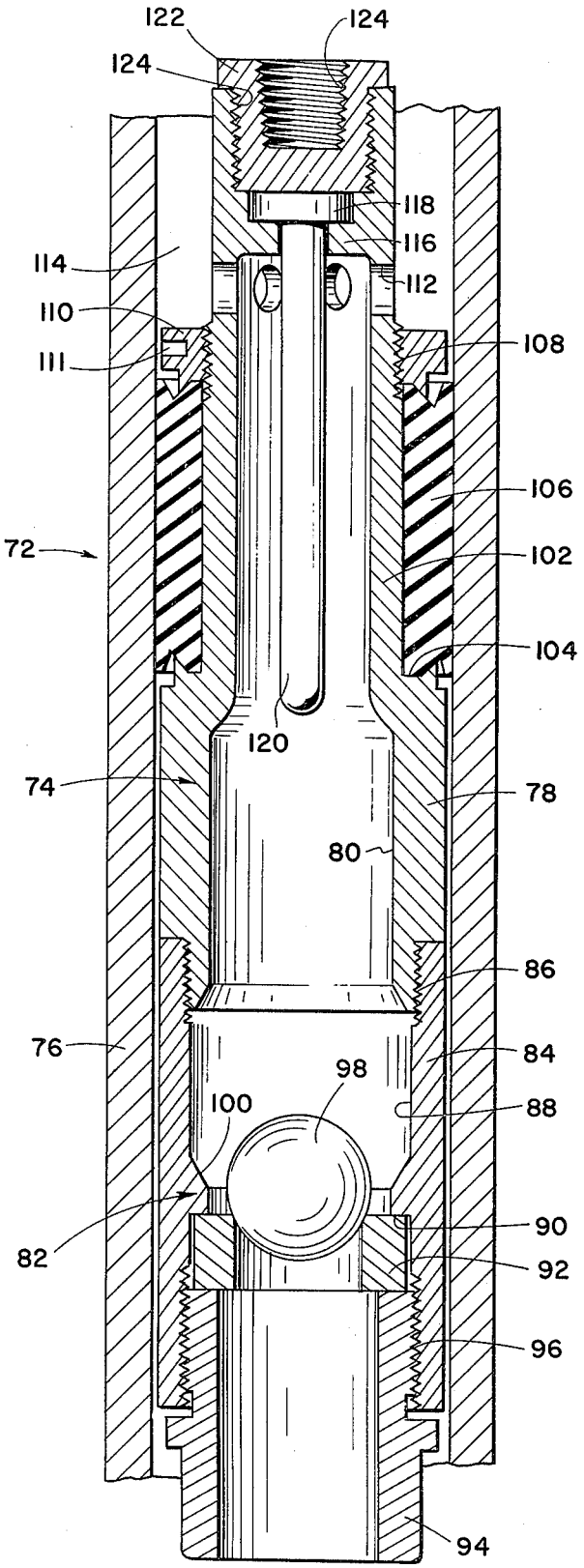
FIG. 3 is a sectional elevational view of a modified oil well pump embodying the invention.

Referring now to FIG. 3 a similar subsurface oil well pump is generally indicated at 72. The pump 72 comprises a plunger assembly 74 reciprocally disposed within a stationary working barrel 74. However, it is to be understood that the plunger assembly 74 may be held stationary and the working barrel 74 reciprocated with respect thereto, if desired.

The plunger assembly 74 comprises a main sleeve 78 having a central bore 80 extending longitudinally therein to provide a fluid passageway. A check valve assembly 82 is removably secured to one end of the sleeve 80. The valve 82 comprises an outer housing 84 threadedly secured to the sleeve 80 at 86 and having a central bore 88 in open communication with the passageway 80. An inwardly directed annular shoulder 90 is provided in the bore 88 for receiving a suitable annular valve seat 92 thereagainst, and the valve seat 92 is securely retained in position by a retainer sleeve 94 which is threadedly secured at 96 to the lower or outer end of the sleeve 84. A ball member 98 is loosely disposed within the sleeve 84 and cooperates with the valve seat 92 to provide alternate open and closed positions for the valve 82. It is preferable to provide a beveled or inwardly tapered annular shoulder 100 in the bore 88 spaced above the valve seat 92 for facilitating guiding of the ball 98 onto the valve seat 92 during closing of the valve 82 as is well known.

The outer diameter of the sleeve 78 is reduced at 102 to provide a circumferential shoulder 104 around the outer periphery thereof. A sleeve 106 of the same type as the sleeve 32 is disposed around the reduced neck portion 102 and one end thereof is disposed on the shoulder 104. A threaded portion 108 is provided on the outer periphery of the reduced neck 102 and is longitudinally spaced from the shoulder 104 as clearly shown in FIG. 3 for receiving a suitable jamb nut 110 thereon. The jamb nut 110 engages the opposite end of the sleeve 106 and may be threadedly adjusted on the neck 102 for selectively applying longitudinal pressure on the sleeve 106 in order to increase the outer diameter thereof to adjust the pressure of the outer periphery of the sleeve 106 against the inner periphery of the working barrel 76 as hereinbefore set forth.

A plurality of circumferentially spaced outlets or ports 112 are provided in the walls of the neck 102 spaced above the threaded portion 108 to provide communication between the bore 80 and the annular space 114 between the neck 102 and the working barrel 76. The upper end of the bore 80 as viewed in FIG. 3 is closed by an inwardly directed annular flange 116 which supports a disc or plate 118 having a shank or stem 120 extending axially therefrom through the bore 80. A retaining cup member 122 is threadedly secured at 124 to the neck 102 above the disc 118 and bears thereagainst for securely retaining the disc 118 in position against the flange 116 and for cooperating therewith to close the upper end of the bore 80. Of course, suitable sealing means may be interposed between the disc 118 and the neck 108 and/or between the disc 118 and the retainer cup 122 for precluding leakage of fluid therebetween. The retainer 122 is internally threaded at 124 for connection with the usual sucker rods (not shown). Of course, if the sucker rods are hollow, the disc 118 may be of a spider-type or open construction and the cup 122 may be an open sleeve in order that the fluid may move upwardly through the hollow sucker rods.

The operation of the subsurface pump 74 is substantially identical with the operation of the pump 10. The upward movement of the ball 98 is limited by the engagement thereof with the shank member 120. It will be apparent that a suitable helical spring (not shown) similar to the spring 60 may be disposed around the shank 120 and suspend therebelow for cushioning the initial engagement of the ball 98 with the shank 120 in order to dampen the shock of the engagement therebetween. Furthermore, it will be apparent that the length of the shank 120 may be selected in order to provide substantially any desired length of travel for the ball 98 within the bore 80. Of course, the pressure of the outer periphery of the sleeve 106 against the inner periphery of the working barrel 76 may be adjusted by moving the nut 110 along the threaded portion 108, which may be accomplished in any well known manner, such as by inserting an Allen wrench (not shown) or the like in a complementary bore 111 provided in the outer periphery of the nut 110 in order to rotate the nut about the threaded 108.

From the foregoing it will be apparent that the present invention provides a novel subsurface pump for producing oil wells wherein a simple reciprocal plunger member is disposed within the working baarrel. The usual travelling valve or check valve is carried by the plunger and preferably disposed within the plunger for facilitating admitting of the well fluid from the fluid reservoir in the well bore to the interior of the tubing string or to the interior of the hollow sucker rod string, for advancing or lifting the well fluid to the surface of the ground. Resilient sleeve means is disposed around the outer periphery of the plunger for engaging the inner periphery of the working barrel for providing efficient pumping action on each stroke of the plunger. The pressure engagement of the sleeve against the working barrel may be selectively adjusted to compensate for any wear during operation of the pump for assuring a long and efficient life for the pump.

Whereas the present invention has been described in particular relation to the drawings attached hereto, it should be understood that other and further modifications, apart from those shown or suggested herein, may be made within the spirit and scope of this invention.

What is claimed is:

1. A subsurface well pump comprising a first elongated stationary tubular member in communication with a well fluid reservoir, a second elongated tubular member in communication with the well fluid and concentrically arranged with respect to the stationary tubular member and reciprocal with respect thereto, check valve means disposed within one of said tubular members to provide alternate open and closed positions for the pump during operation thereof, resilient sleeve means disposed around the outer periphery of the said one tubular member and engagable with the inner periphery of the other tubular member, stop means provided on the outer periphery of the said one tubular member and engagable by one end of the resilient sleeve means, adjustment means movably secured to the outer periphery of the said one tubular member and selectively engagable with the opposite end of the resilient sleeve means for applying longitudinal pressure thereto whereby the outer diameter of the resilient sleeve may be varied, and discharge port means provided for the said one tubular member for discharging the well fluid therefrom for elevation of the fluid to the surface of the well during operation of the pump; said check valve means comprising an annular valve seat member removably secured within said one tubular member, cage means supported by the valve seat member, a ball member freely disposed within said cage means and cooperating with the valve seat to provide said open and closed positions for the pump, and stop means carried by the cage means for limiting the movement of the ball during opening of the check valve; and said stop means comprising longitudinally extending stem means centrally disposed within the said cage means and secured thereto, and helical spring means disposed around the stem means and having one end secured thereto and the opposite end suspended freely therebelow for cushioning the engagement of the ball member with the stem means.

* * * * *